US006585083B2

(12) United States Patent
Santarlasci

(10) Patent No.: US 6,585,083 B2
(45) Date of Patent: Jul. 1, 2003

(54) SCAFFOLD CONSTRUCTION APPARATUS AND METHOD

(76) Inventor: Roland R. Santarlasci, 941 Baileys Run Rd., Tarentum, PA (US) 15084

( * ) Notice: Subject to any disclaimer, the term of this patent is extended or adjusted under 35 U.S.C. 154(b) by 0 days.

(21) Appl. No.: 09/785,898

(22) Filed: Feb. 16, 2001

(65) Prior Publication Data

US 2002/0043428 A1 Apr. 18, 2002

Related U.S. Application Data

(60) Provisional application No. 60/185,072, filed on Feb. 25, 2000.

(51) Int. Cl.[7] ..... E06C 7/16; E04G 1/00; E04G 3/00

(52) U.S. Cl. ..... 182/118; 182/186.7; 182/186.8; 182/178.1; 248/201; 248/229.25

(58) Field of Search ..... 182/186.7, 186.8, 182/178.1; 52/638, 637, 645, 646; 248/201, 229.25, 228.6, 231.71

(56) References Cited

U.S. PATENT DOCUMENTS 1,003,407 A * 9/1911 Abrams ..... 182/178.2
2,897,013 A * 7/1959 Delp ..... 182/186.8 X
3,190,405 A * 6/1965 Squire ..... 52/637
3,345,655 A * 10/1967 Juculano ..... 182/186.8 X
3,462,021 A * 8/1969 Hawke et al. ..... 182/186.7 X
4,083,427 A 4/1978 Box
4,086,979 A 5/1978 Dunn
4,481,748 A * 11/1984 D'Alessio et al. ..... 52/638
4,534,447 A 8/1985 Champigny
4,602,470 A * 7/1986 Stuart et al. ..... 52/638 X
4,841,708 A * 6/1989 Johnston ..... 52/646
5,135,077 A * 8/1992 Shalders ..... 182/178.1
5,255,758 A 10/1993 Hood
5,263,296 A * 11/1993 Spera ..... 52/638
5,287,947 A * 2/1994 Mc Swain ..... 182/179.1
5,332,062 A 7/1994 Revere
6,427,803 B1 * 8/2002 Moore ..... 182/107

* cited by examiner

*Primary Examiner*—Daniel P. Stodola
*Assistant Examiner*—Hugh B. Thompson
(74) *Attorney, Agent, or Firm*—Jones, Tullar & Cooper, P.C.

(57) ABSTRACT

Two ladders are connected together with cross-braces to form a scaffold. Platforms of the scaffold are supported on rungs of the ladders. A C-shaped bracket connects to the ladder legs. The bracket has an ear for connecting a brace.

9 Claims, 7 Drawing Sheets

SCAFFOLD CONSTRUCTION APPARATUS AND METHOD

CROSS-REFERENCE TO RELATED APPLICATION

The benefit of provisional application No. 60/185,072 filed Feb. 25, 2000 is claimed. Provisional application No. 60/185,072 filed Feb. 25, 2000 is incorporated herein by reference.

BACKGROUND OF THE INVENTION

Field of the Invention

The present invention relates to scaffolds, and to cross-bracing of structures.

SUMMARY OF THE INVENTION

Commonly available scaffolding is expensive and requires a large amount of space for storage. What is needed is an apparatus which can temporarily convert existing ladders to scaffolds. Thus would be less expensive than purchasing regular scaffolding, because a person can use ladders that he or she already owns, and which can still be used as ladders when scaffolding is not required. Storage space would be lessened, because in addition to the ladders which would have to be stored anyway, one would only need to store the cross-braces, the hardware which connects the cross-braces to the ladders, and the platforms.

Scaffold construction apparatus of the present invention includes braces, brackets, fasteners and platforms, which are provided for creating a scaffold using two ladders, positioned with broad sides thereof facing each other, in parallel relationship to each other.

Braces are combined in pairs to form cross-shaped first and second brace structures connected to one another at their crossovers, in this example at the centers thereof, by fasteners. The first brace structure spans between and connects to the first and second ladders. The second brace structure spans between and connects to the first and second ladders and is positioned opposite the first brace structure. The first and second brace structures are attached along the ladders in pairs, as often as required to create a sturdy structure. Each of the brackets comprises two opposed end plates, and a side plate which spans between and connects the end plates. An ear extends outwardly from the side plate. One of the brackets is fastened to each end of each of the braces by inserting a fastener through an aperture in the ear.

The brackets are attached to the ladder legs by positioning the side plate on an outward facing side of the leg, and directing the end plates inward. Fasteners are inserted through apertures in the end plates such that one of the fasteners extends across and above a rung of the ladder, and another of the fasteners extends across and below the rung of the ladder. This particular positioning of the fasteners through the end plates fixes the bracket to the rung and ensures that the braces cannot slip beyond the rungs in either an upward or a downward direction. The platforms rest on the rungs of the ladders and span between the ladders.

Still further features and advantages will become apparent from the ensuing description and drawings.

DETAILED DESCRIPTION

Figure 1:
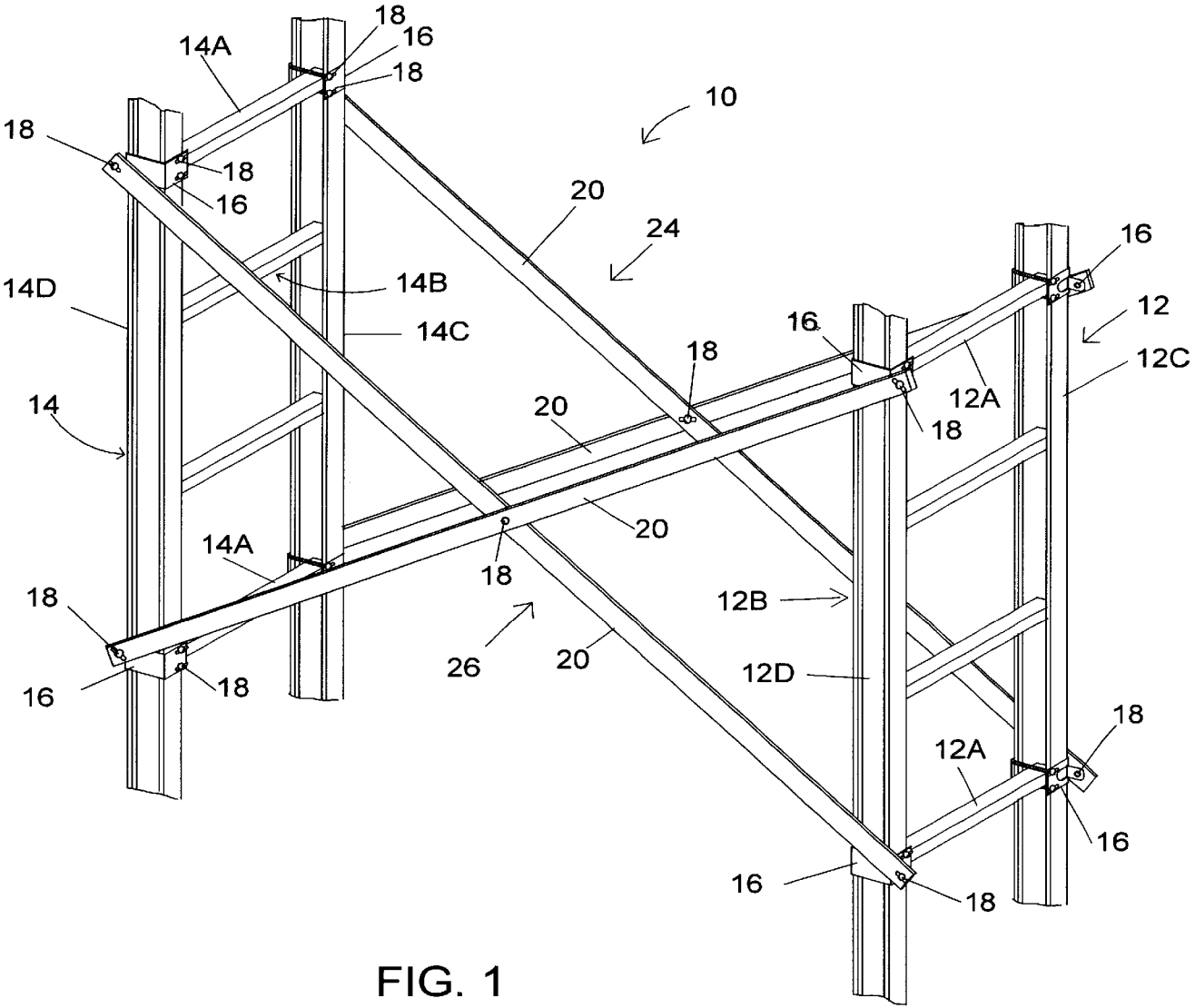
FIG. 1 is a partial perspective view showing a scaffold construction apparatus of the present invention installed on portions of two ladders.
Figure 2:
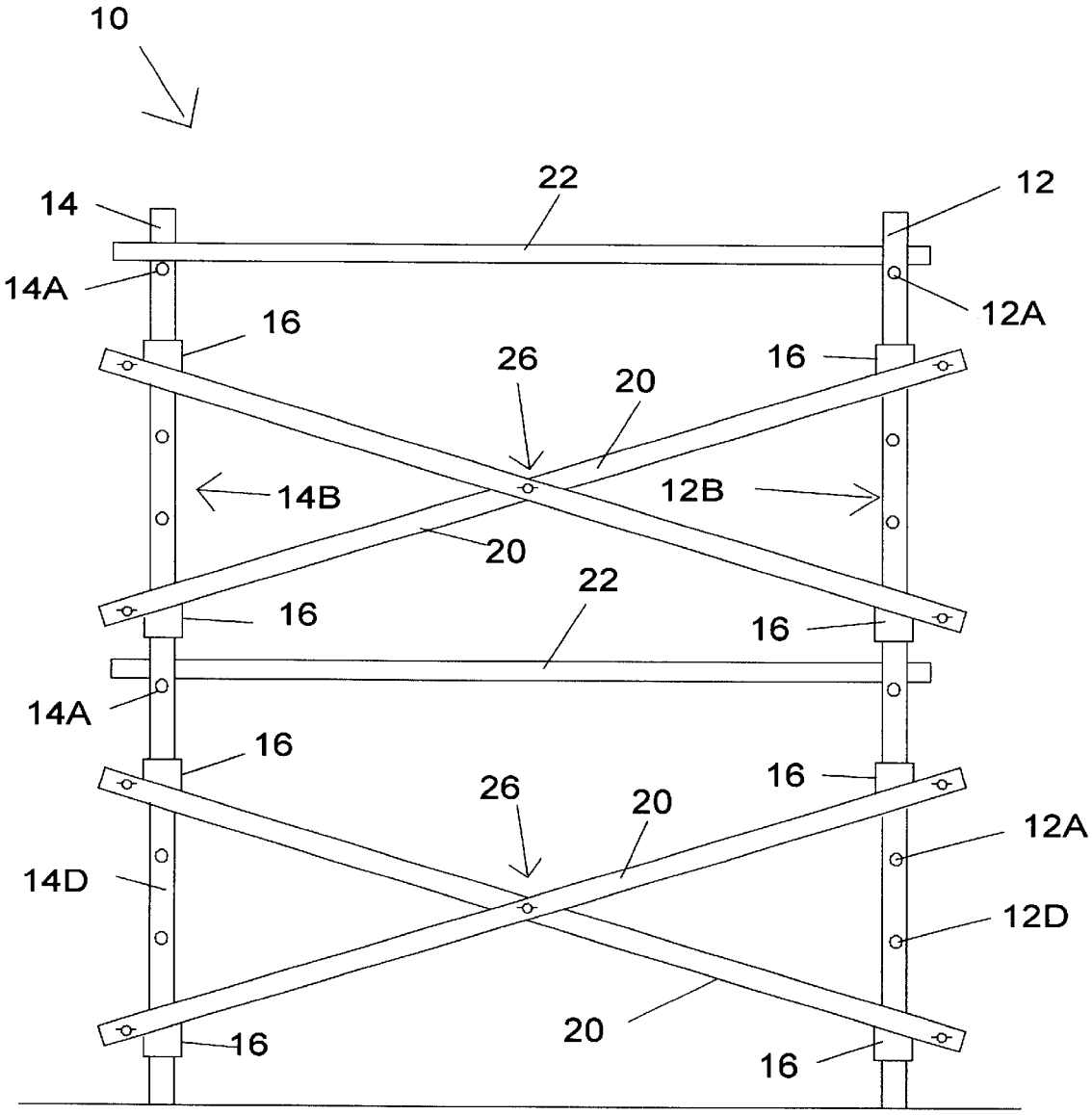
FIG. 2 is a complete elevational view of the scaffold construction apparatus installed on two ladders on level ground.
Figure 3:
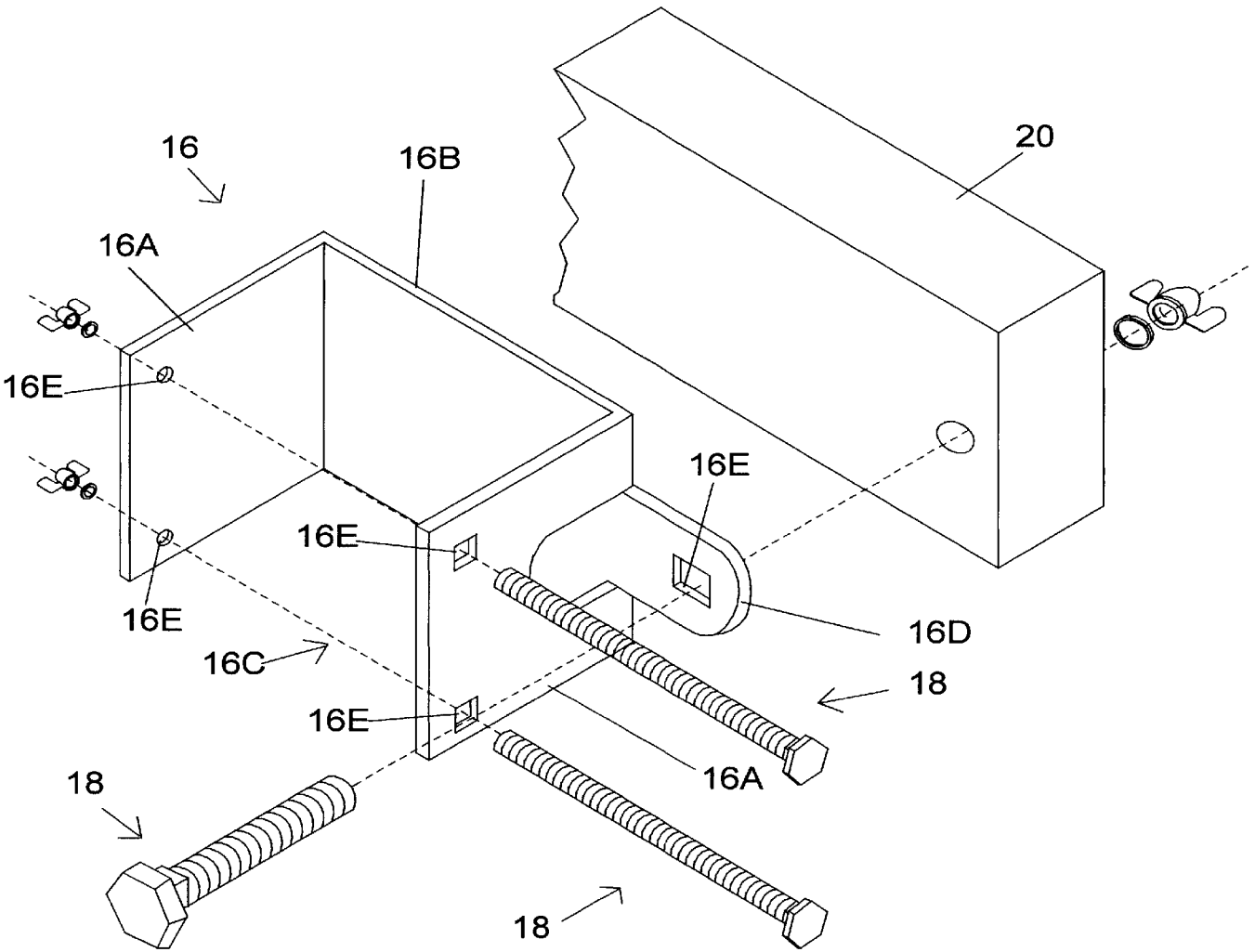
FIG. 3 is an enlarged, exploded, partial perspective view showing the bracket of the scaffold construction apparatus.

FIG. 1 is a partial perspective view showing a scaffold construction apparatus 10 of the present invention installed on portions of first and second ladders 12, 14. FIG. 2 is a complete elevational view of scaffold construction apparatus 10 installed on the ladders 12, 14, to create a scaffold composed of apparatus 10 and the ladders 12, 14. FIG. 3 is a partial exploded perspective view showing a bracket 16 of the scaffold construction apparatus 10.

Referring to the figures, the apparatus 10 comprises a plurality of the brackets 16, fasteners 18, and braces 20. Platforms 22 are adapted to span between and rest upon rungs 12A, 14A of the ladders 12, 14.

The ladders 12, 14 are positioned with broad sides 12B, 14B thereof facing each other, in parallel relationship to each other. Each of the ladders 12, 14 has a first leg 12C, 14C and a second leg 12D, 14D. The first legs 12C, 14C are positioned opposite each other. The second legs 12D, 14D are positioned opposite each other.

The braces 20 are combined in pairs to form cross-shaped first and second brace structures 24, 26 connected at centers thereof by the fasteners 18, which may comprise conventional carriage bolts, lock washers and wing nuts. The first brace structure 24 spans between and connects to the first legs 12C, 14C of the first and second ladders 12, 14. The second brace structure 26 spans between and connects to the second legs 12D, 14D of the first and second ladders 12, 14, and is positioned opposite the first brace structure 24.

The first and second brace structures 24, 26 are attached along the ladders 12, 14 in pairs, as often as required to create a sturdy structure. For example, in FIG. 2, each ladder is 20-feet long, and there are two pairs of cross-brace structures 24, 26, one pair for each 10-feet of ladder length.

Figure 4:
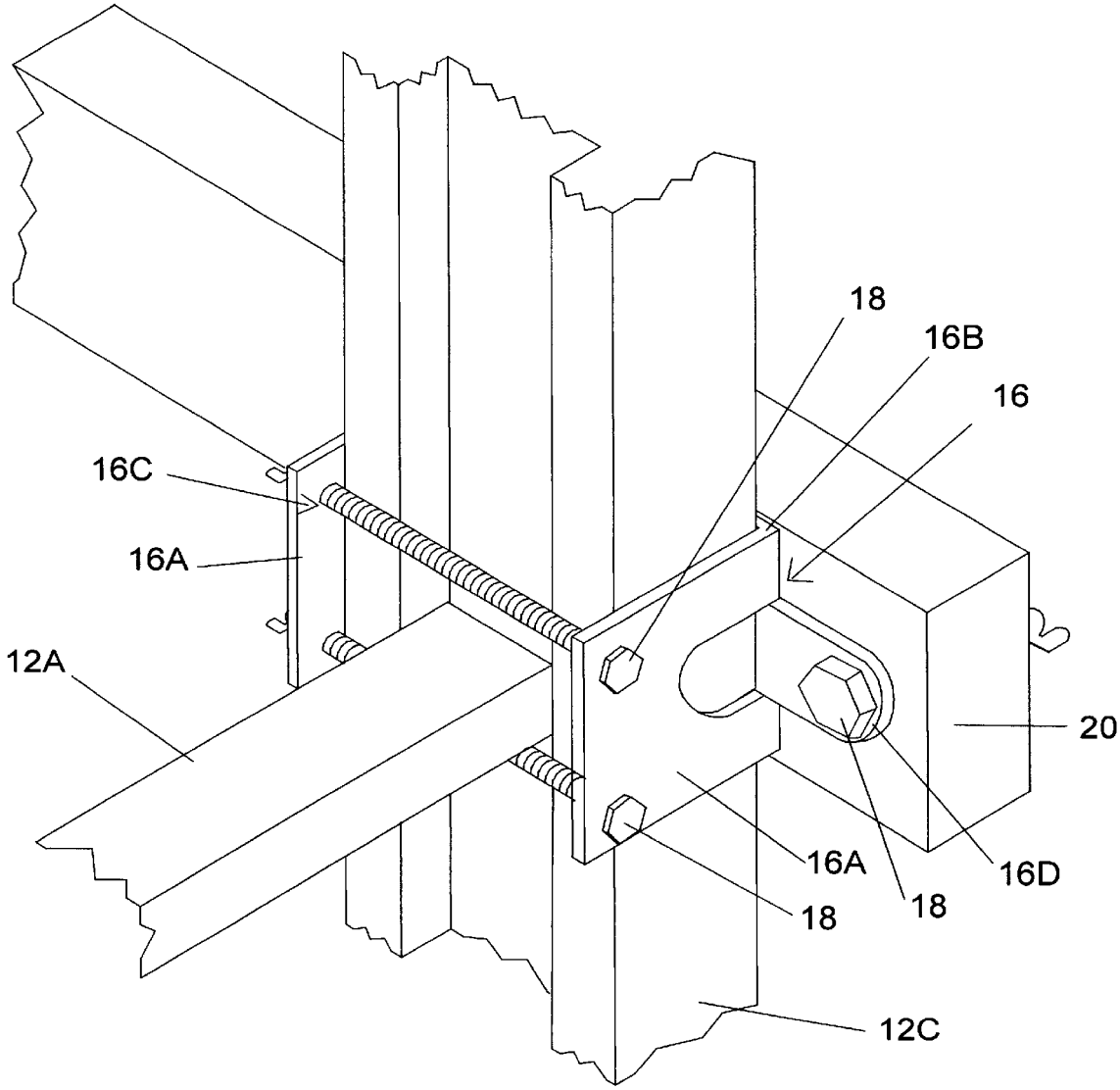
FIG. 4 is an enlarged partial perspective view showing the bracket installed on one of the ladders.

FIG. 4 is an enlarged perspective view showing the bracket 16 installed on the first ladder 12. Referring now primarily to FIGS. 3 and 4, each of the brackets 16 comprises two opposed end plates 16A, and a side plate 16B which spans between and connects the end plates 16A. The end plates 16A and the side plate 16B together, generally form a C-shape having an open side 16C opposite the side plate 16B. An ear 16D extends outwardly from the side plate 16B. Advantageously, the plane of the ear is parallel to the plane of the side plate and the plane of the ear coincides with the plane of the side plate. Apertures 16E are provided in the ear 16D and in the end plates 16A. The apertures 16E in the end plates 16A are positioned near the open side 16C.

While ear 16D may be welded in place, or be part of a cast or molded bracket, advantageously bracket 16 is a unitary piece of wrought metal, with ear 16D coming from one of the end plates 16A, as shown by the matching aperture in the neighboring end plate in FIGS. 3 and 4, this being done, for instance, by oxy-acetylene cutting along the outline of the ear before the end plates are bent 90-degrees from the side plate, or by stamping or other form of shearing at the same time that the end plates are being bent 90-degrees from the side plate.

One of the brackets is fastened to each end of each of the braces 20, by inserting a carriage bolt of the fastener 18 through the aperture 16E in the ear 16D, and completing the fastener 14 in a conventional fashion, as shown in FIG. 3.

The method of installation of the bracket 16 will be described herein by referring to the first ladder 12. The method is exactly the same for installation on the second ladder 14. One of the brackets 16 is attached to the first leg 12C of the first ladder 12 by positioning the side plate 16B on an outward facing side of the first leg 12C, and directing the end plates 16A inward. Carriage bolts of the fasteners 18 are inserted through the apertures 16E of the end plates 16A such that the bolts straddle the rung, with one of the carriage bolts extends across and above the rung 12A of the first ladder 12, and another of the carriage bolts extends across and below the rung 12A of the first ladder 12. This particular positioning of the carriage bolts through the end plates 16A ensures that the braces 20 cannot slip beyond the rungs 12A in either an upward or a downward direction.

It is envisioned that the platforms 22 may be conventional wooden planks, and the braces 20 may be conventional nominal 2×4 wood members. The braces 20 and the platforms 22 may be provided with the brackets 16, or the components may be purchased separately. For example, and not by way of limitation, the brackets 16 may be packaged with the fasteners 18 with instructions for making the scaffold using a customer's own ladders 12, 14, and using a customer's own wooden planks and members for the platform 22 and braces 20.

FIG. 2 shows the scaffold on level ground. If the ground is sloping, for instance so that ladder 12 is lower than ladder 14, blocks may be placed under ladder 12, to bring it to the same height as ladder 14, so that the carriage bolts of the brackets on ladder 12 will correctly straddle the rungs.

Figure 2A:
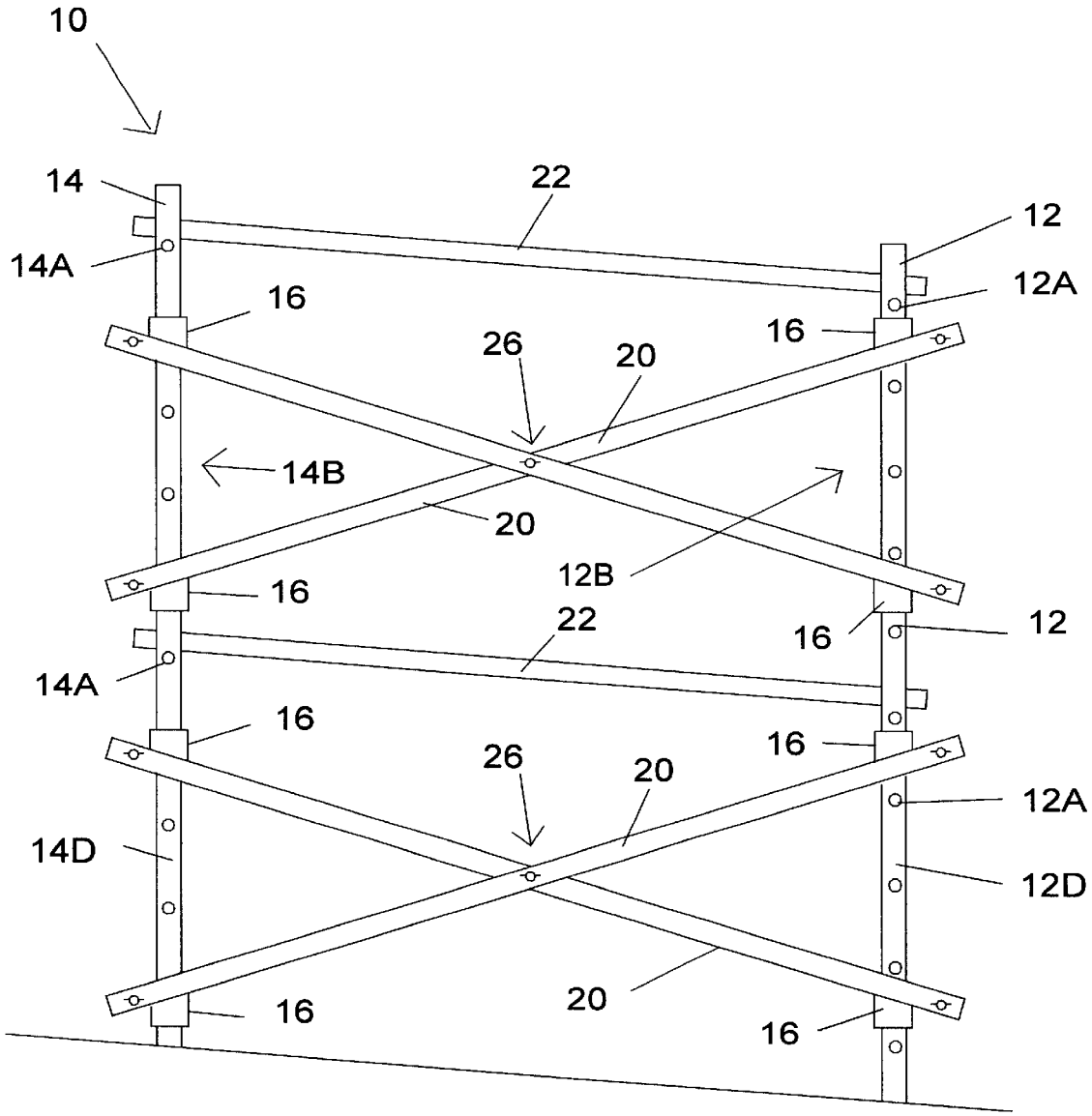
FIG. 2A is a view as in FIG. 2 of the scaffold construction apparatus installed on two ladders on sloping ground.

Interestingly, however, it has been discovered that the scaffold of the invention is just as stable, even if the bolts do not straddle the rungs. For instance, as shown in FIG. 2A, ladder 12 is somewhat lower than ladder 14, due to the fact that the ground is sloping. Both ladders are placed vertical, parallel to one another. The brackets 16 are fixed to the rungs on ladder 14, as indicated by the fact that brackets 16 hide their associated rungs in the drawing on ladder 14, while the brackets 16 on ladder 12 are not fixed to the rungs, this being indicated by the fact that all rungs of ladder 12 are visible in the drawing. As long as the brackets are attached to the legs of ladder 12, either slidably or fixedly, it does not matter that they lie in the space between a rung above and a rung below, rather than being fixed to a rung. The scaffold is stable nevertheless.

With ladder 12 being lower than ladder 14 in FIG. 2A, platform 22 slopes somewhat, because the rungs of ladder 14 are not be at the same elevation as the rungs of ladder 12. It has been found, however, that the slope is small, even at its maximum, such that it does not disturb the workers on the scaffold. In general, it is preferred to accept some difference in the levels of the ladders, rather than to place blocks beneath the lower ladder, because blocks can unexpectedly tilt out of place.

Carriage bolts often have a rounded head on top of a square cross-section, although they may have hexagonal heads, as shown in the drawings. Either form is acceptable for the invention. The apertures 16E for the head sides of the carriage bolts have square cross-sections. These square cross-sections of the apertures cooperate with the square cross-sections of the carriage bolts to keep the bolts from turning when the wing nuts are tightened.

Figure 5:
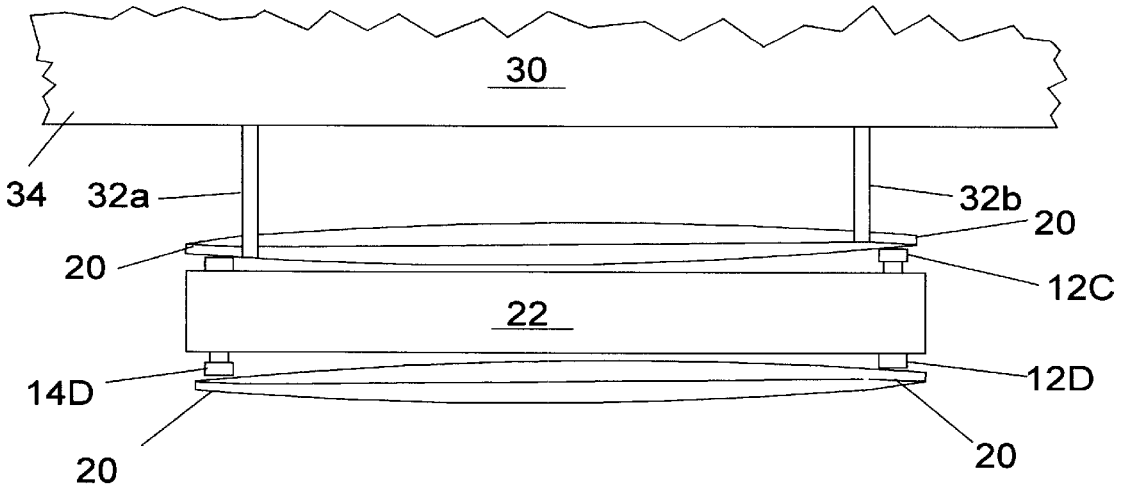
FIG. 5 is a schematic top view of the scaffold assembly of FIG. 2 alongside a building also viewed from above.
Figure 6:
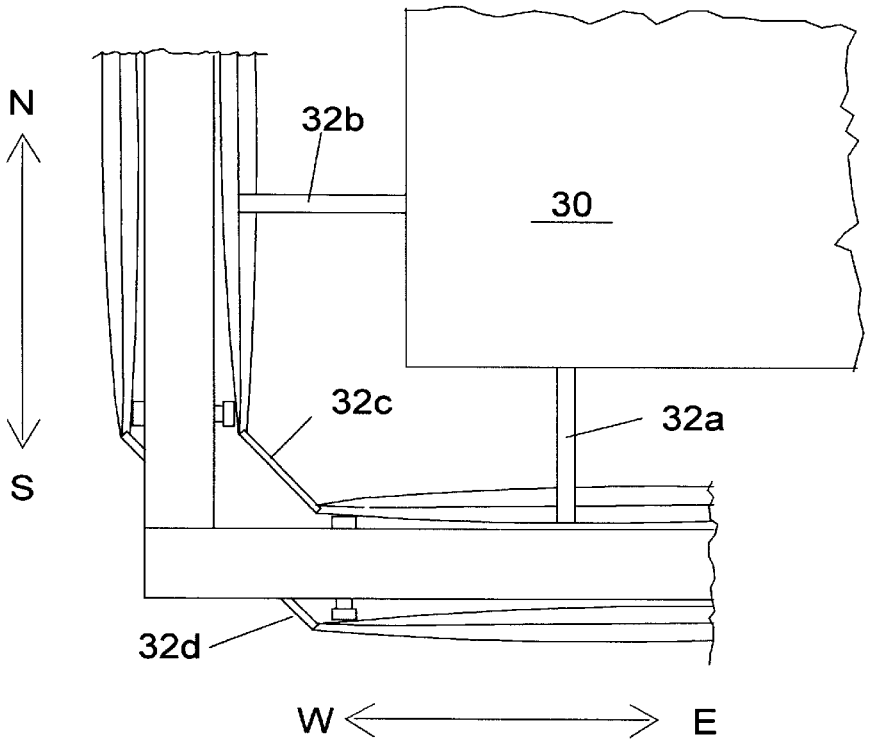
FIG. 6 is a schematic top view of portions of two of the scaffold assemblies of FIG. 2, arranged at the corner of a building also viewed from above.
Figure 7:
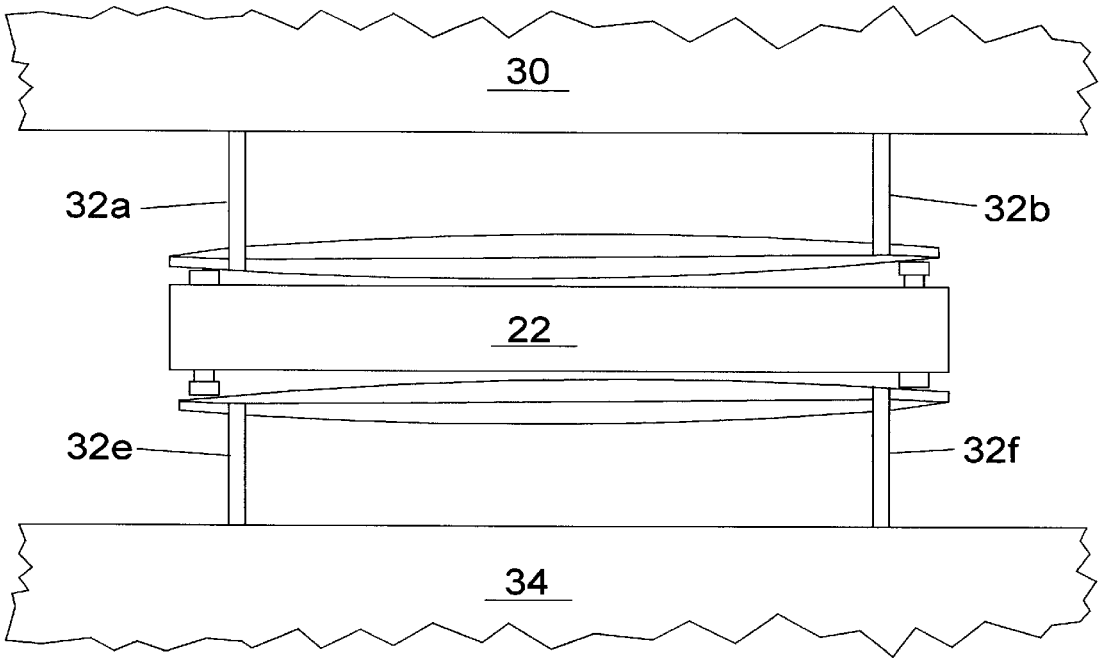
FIG. 7 is a schematic top view of the scaffold assembly of FIG. 2 arranged between two buildings also viewed from above.

FIGS. 5–7 illustrate the coordination of scaffolds of the invention with buildings. In directions left and right in the plane of FIG. 2, the scaffold is very stable. However, due to the relatively small breadth of the ladders (i.e. the relatively short lengths of their rungs), it is preferred to tie the scaffold to a neighboring building, in order to guard against sway in directions perpendicular to the plane of FIG. 2.

Thus, in FIG. 5, the scaffold of FIG. 2 is tied to building by struts 32*a,* 32*b* fastened on the building side to rafters (not shown) beneath the eaves 34 and on the scaffold side to the braces 20.

The embodiment of FIG. 6 further improves stability by wrapping two scaffolds of the invention around the corner of the building 30, the two scaffolds being tied together by struts 32*c,* 32*d* fastened between the braces 20 of the respective scaffolds. Here, the extreme north-south stability of the one scaffold extending north-south couples with the extreme east-west stability of a second scaffold extending east-west to form a unit reinforced against sway, this in addition to the sway resistance provided by the struts 32*a,* 32*b.*

As shown in FIG. 7, an advantage of the relatively small breadth of the ladders is that the scaffold of the invention fits between closely spaced buildings 30 and 34. Here, resistance against sway is also increased by struts 32*e,* 32*f* extending to the other building. In this case, it is also possible to use, instead of struts, taut cables 32*a,b,e* and *f.*

The foregoing description is included to describe embodiments of the present invention which include the preferred embodiments, and is not meant to limit the scope of the invention. From the foregoing description, many variations will be apparent to those skilled in the art that would be encompassed by the spirit and scope of the invention.

For instance, while bolts represent a preferred fastener for fixing the end plates of the bracket relative to a rung, an alternative fastener may be comprised of a fork hinged to one end plate and whose tines can be swung to straddle a rung, with the ends of the tines then being secured to the other end plate. Another alternative is a bicycle padlock: the shackle of the padlock protrudes through the two holes of one end plate, straddles the ladder rung, then protrudes through the two holes on the other end plate and into locking engagement in the body of the padlock.

What is claimed is:

1. A bracket comprising two opposed end plates, a side plate which spans between and connects the end plates, an ear on and extending outwardly from the side plate, and means in the end plates to locate fasteners secured to the end plates such that the fasteners are spaced apart to straddle a rung of a ladder, the end plates and side plate being adapted to engage a leg of the ladder while permitting the fasteners to straddle the rung.

2. The bracket as claimed in claim 1, the ear having an aperture.

3. The bracket as claimed in claim 1, the ear being parallel to the side plate.

4. The bracket as claimed in claim 1, the ear being coplanar with the side plate.

5. The bracket as claimed in claim 1, the side and end plates being wrought metal, the ear coming from one of the end plates.

6. The bracket as claimed in claim 1, said means comprising two bolt apertures in each end plate.

7. A method of constructing a scaffold, comprising attaching brackets onto two parallel, vertical, broad-side facing ladders, each bracket comprising two opposed end plates, and a side plate which spans between and connects the end plates, with the side plate of each bracket on an outward facing side of a leg of the ladders, and the end plates directed inwards, connecting a cross-brace to ears on, and extending outwardly from, the side plates of the brackets, and fixing the brackets on a respective leg of one of the ladders so that fasteners secured therto straddle rungs of the respective ladder.

8. The method as claimed in claim 7, further comprising fixing the brackets on only one of the ladders to rungs of the respective ladder, the brackets on the other of the ladders being attached to the legs of the respective ladder between rungs.

9. The method as claimed in claim 8, the cross brace comprising two braces crossing one another at a crossover location, the method further comprising connecting the braces to one another at the crossover location.

* * * * *